US010676678B2

(12) United States Patent
Pradeep et al.

(10) Patent No.: US 10,676,678 B2
(45) Date of Patent: Jun. 9, 2020

(54) PROCESS FOR CONVERSION OF HIGH ACIDIC CRUDE OILS

(71) Applicant: INDIAN OIL CORPORATION LIMITED, Mumbai (IN)

(72) Inventors: Ponoly Ramachandran Pradeep, Faridabad (IN); Satyen Kumar Das, Faridabad (IN); Terapalli Hari Venkata Devi Prasad, Faridabad (IN); Arjun Kumar Kottakuna, Faridabad (IN); Rajesh, Faridabad (IN); Kashyapkumar Mahendra Pastagia, Faridabad (IN); Debasis Bhattacharyya, Faridabad (IN); Sanjiv Kumar Mazumdar, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 16/206,936

(22) Filed: Nov. 30, 2018

(65) Prior Publication Data

US 2019/0225892 A1 Jul. 25, 2019

(30) Foreign Application Priority Data

Jan. 20, 2018 (IN) ..... 201821002414

(51) Int. Cl.

| | |
|---|---|
| ***C10G 9/34*** | (2006.01) |
| ***C10G 7/00*** | (2006.01) |
| ***C10G 55/04*** | (2006.01) |
| ***C10B 57/04*** | (2006.01) |
| ***C10B 55/00*** | (2006.01) |
| ***C10G 9/00*** | (2006.01) |

(52) U.S. Cl.

CPC ..... *C10G 9/34* (2013.01); *C10B 55/00* (2013.01); *C10B 57/045* (2013.01); *C10G 7/00* (2013.01); *C10G 9/005* (2013.01); *C10G 55/04* (2013.01); *C10G 2300/203* (2013.01); *C10G 2300/302* (2013.01); *C10G 2300/308* (2013.01); *C10G 2300/708* (2013.01); *C10G 2400/02* (2013.01)

(58) Field of Classification Search

None

See application file for complete search history.

(56) References Cited

U.S. PATENT DOCUMENTS

| | | | | |
|---|---|---|---|---|
| 4,818,370 | A | 4/1989 | Gregoli et al. | |
| 4,840,725 | A | 6/1989 | Paspek | |
| 6,325,921 | B1 | 12/2001 | Andersen | |
| 2014/0275663 | A1* | 9/2014 | Brons | C10L 10/04 585/3 |
| 2015/0376509 | A1* | 12/2015 | Etter | C10G 57/00 208/109 |
| 2016/0369188 | A1* | 12/2016 | Housmans | C10G 65/00 |
| 2018/0362866 | A1* | 12/2018 | Ward | C10G 69/00 |

* cited by examiner

*Primary Examiner* — Tam M Nguyen

(74) *Attorney, Agent, or Firm* — Maschoff Brennan

(57) ABSTRACT

The present invention relates to crude oil processing, particularly related to conversion of crude oil containing high amount of naphthenic acid compounds to lighter hydrocarbon materials with minimum capital expenditure. The invented process utilizes a novel scheme for high TAN crude oils by employing thermal cracking process to maximize the residue conversion to valuable products, which require minimum modifications in unit metallurgies and corrosion inhibitor injection schemes in refineries.

16 Claims, 1 Drawing Sheet

Schematic of high TAN crude processing scheme of present invention

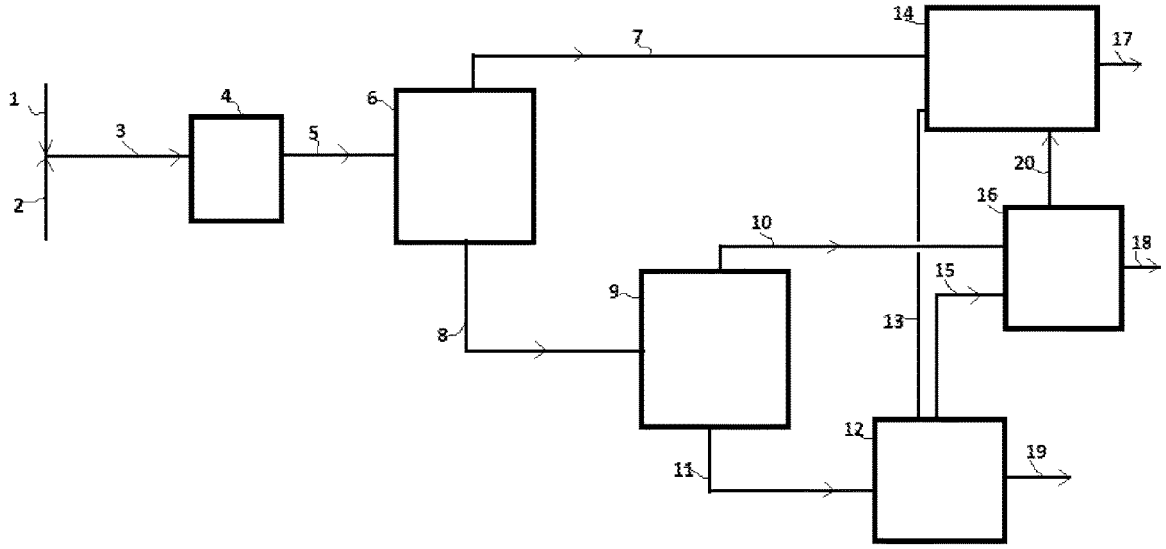
Fig. 1 Schematic of conventional high TAN crude processing scheme by blending
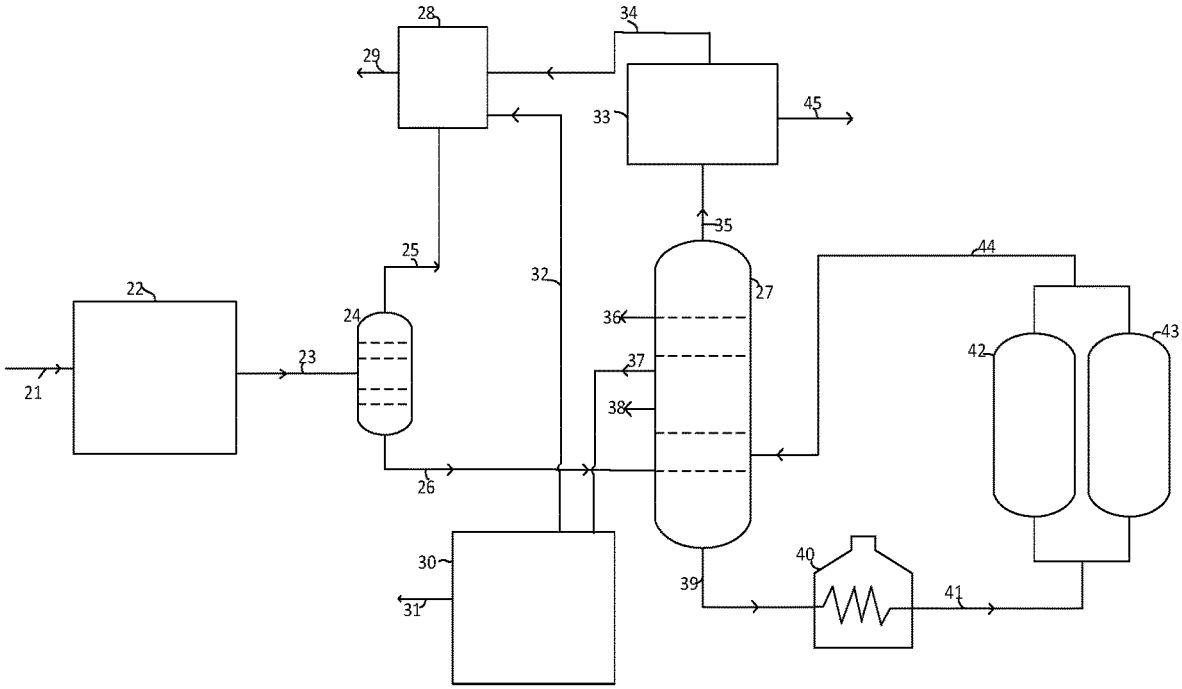
Fig. 2 Schematic of high TAN crude processing scheme of present invention

PROCESS FOR CONVERSION OF HIGH ACIDIC CRUDE OILS

FIELD OF THE INVENTION

The present invention relates to crude oil processing, particularly related to conversion of crude oil containing high amount of naphthenic acid compounds to lighter hydrocarbon materials.

BACKGROUND OF THE INVENTION

Globally, the demand for petroleum feedstock has constantly increased in the past few years and consequently the quality of available crude oils has decreased significantly. The decreasing quality has thereby resulted in a requirement for upgrading the low quality crude oils. Particularly, the highly acidic crude oil has to be processed to provide for the increasing demand for hydrocarbon resources, which also enhances the refiner's profitability due to lower price in comparison with low acidic crude oils. Currently, there are several refining process for processing the low quality crude oil.

However, there are many serious problems raising during storage, refining, and transportation of highly acidic crude oils due to its strong tendency for corrosion. More specifically, corrosion of metal surfaces, which ultimately requires frequent changes of the corroded parts or use of expensive refractory metals. The corroded metallic compounds cause serious plugging problems in piping.

The low quality crude oil containing large amount of organic acid has low economic value due to difficulties in processing the same. Most of the organic acids have carboxylic acid functional groups. More specifically, Naphthenic acid, a representative organic acid compound having carboxylic acid functional group on hydrocarbon molecules of long chain paraffin with cyclopentane is further more difficult to process.

A number of methods have been suggested to de-acidify acidic petroleum oil. The methods comprise of adding basic compounds to neutralize acidity of petroleum oils. Methods of adding Polymeric compounds having enough basicity to trap or neutralize acidic compounds in crude oil were also disclosed in the past to decrease acidity of crude oils. Further, naphthenic acid compounds, which are representative acidic compounds found in crude oil, can also be converted to esteric compounds through reaction with alcoholic compounds in the presence or absence of catalyst. Furthermore, extractive separation is also known for separating organic acidic compounds, including naphthenic acid compounds, from petroleum oil. In addition, various solvents were tried to separate organic acidic compounds, such as salt and water-oil emulsion containing concentrated naphthenic acid compounds. Also, catalytic processes have been evaluated, typically with mild reaction conditions. The known processes tend to treat merely a cut of the crude stream and not the whole crude stream. Therefore, in order to protect metal surface from corrosion, corrosion inhibitors can be used to passivate metal surface prior to being subject to acidic crude oil.

U.S. Pat. No. 6,325,921 B1 (Andersen) discloses a method of removing metal impurities contained in heavy petroleum feedstock by processing a particular cut of the crude oil with supercritical water in the presence of a solid catalyst. Andersen teaches fractionation to produce an atmospheric residue which is then treated with zirconium oxide catalyst. The fractionation is typically performed within a refinery and not at the site of production. Thus, Andersen describes transporting corrosive acidic crude to the refinery site. Furthermore, Andersen teaches the exposure of the fractionation column to acidic crude, thus resulting in a costly refining process. Finally, the Andersen method suffers from the production of sludge and coke formation that quickly plug lines.

U.S. Pat. No. 4,840,725 (Paspek et al) discloses a process for conversion of high boiling hydrocarbon to low boiling petroleum with water of supercritical condition in the absence of catalyst. Paspek does not teach the removal of acidic compounds nor would the process as taught by Paspek remove such compounds. Furthermore, Paspek does not teach treating the crude at the on-site production facility, so the crude identified in Paspek must be transported, which would further lead to corrosion when the crude is acidic. Finally, the method described in Paspek leads to the formation of coke, however the amount of coke produced is less than the conventional methods.

U.S. Pat. No. 4,818,370 (Gregoli et al) discloses a process for converting heavy hydrocarbon, such as tars and bitumen to light hydrocarbon by supercritical water in the presence of brine.

There are number of problems associated with simply de-acidifying acidic crude oils. However, methods to de-acidify highly acidic crude oils disclosed in the prior art require either special chemicals which are not present in the original crude oil or require employment of complicated processes which cannot be conducted at an on-site production facility. Additionally, the methods disclosed in the prior art either degrade the quality of the crude oil or otherwise do not significantly improve or upgrade other qualities of crude oil, such as viscosity, density, and sulfur, and metals content.

The prior-arts also propose the use of corrosion inhibitors to passivate metal surface in order to protect metal surface from corrosion, corrosion inhibitors. More specifically, organic polysulfide or phosphites or phosphoric acid were proposed to provide good performance to form protective film on metal surface. However, this technique suffers from the additional expense of the injection and re-injection of inhibitors in order to maintain sufficient thickness of the protective film. Also, each metal item contacting the acidic crude must be contacted with an operable amount of the corrosion inhibitor to be treated, instead of merely removing the problematic functional group from the crude.

Therefore, an efficient process is needed to process acidic crude oil at the refinery with minimum requirement of metallurgy changes and corrosion inhibitor usage. It would be further advantageous to propose a process which can cause conversion of crude oil to valuable products while reducing the acidity.

Further, acidity of crude oil is measured through titration with potassium hydroxide to estimate total acid number ("TAN") as milligram of KOH required to titrate one gram of crude oil. Crude oils having a TAN over 0.5 are generally regarded as acidic crude oils. This definition can change between countries or a lower TAN can be specified for an end product. It is also observed that the naphthenic acid compounds contributing to TAN normally concentrate in the heavier fraction of the crude oil boiling above 200-230° C. The present invention addresses acid in crude and is therefore useful for reducing acid and offers a way to process high acidic crude oils in petroleum refineries with minimum changes in the metallurgy of equipments and use of corrosion inhibitors.

SUMMARY OF THE INVENTION

An objective of the present invention is to provide a novel scheme for processing high TAN crude oils by employing thermal cracking process to maximize the residue conversion to valuable products while reducing the acidity, which require minimum modifications in unit metallurgies and corrosion inhibitor injection schemes in refineries.

Further objective of the present invention is processing the crude oil to produce lighter hydrocarbon materials.

Yet another objective of the present invention is to provide a scheme employing a severe thermal conversion route for conversion of high acidic crude with simultaneous removal of catalyst poisons like heavy metals (Nickel, Vanadium and Iron etc.) before routing for further processing in downstream units.

An embodiment of the present invention provides a method for processing of liquid hydrocarbon feedstock by thermal cracking process, wherein the said method comprises the steps of:

a) desalting neat high acidic crude oil to obtain desalted crude;
b) separating the desalted crude in a pre-fractionator column into lighter hydrocarbon material and heavier boiling material, wherein the lighter hydrocarbon material comprises of hydrocarbons boiling below 200° C.;
c) routing the heavier boiling material to the bottom section of a fractionator column and mixing with internal recycle component to obtain a secondary feed;
d) heating the secondary feed obtained in step (c) to a high temperature to obtain a hot feed;
e) thermally reacting the hot feed obtained in step (d) in reactor to obtain product vapors and coke;
f) routing the product vapors obtained in step (e) to the fractionator column for fractionation into product fractions.

BRIEF DESCRIPTION OF THE DRAWINGS

FIG. 1 represents schematic of conventional high TAN crude processing scheme by blending.

FIG. 2 represents schematic of high TAN crude processing scheme of present invention.

DESCRIPTION OF THE INVENTION

While the invention is susceptible to various modifications and/or alternative processes and/or compositions, specific embodiment thereof has been shown by way of example in tables and will be described in detail below. It should be understood, however that it is not intended to limit the invention to the particular processes and/or compositions disclosed, but on the contrary, the invention is to cover all modifications, equivalents, and alternative falling within the spirit and the scope of the invention as defined by the appended claims.

The tables and protocols have been represented where appropriate by conventional representations, showing only those specific details that are pertinent to understanding the embodiments of the present invention so as not to obscure the disclosure with details that will be readily apparent to those of ordinary skill in the art having benefit of the description herein.

The following description is of exemplary embodiments only and is NOT intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

The present invention relates to a method of processing high total acid number (TAN) crude oils by thermal cracking process to deacidify the crude oil along with converting it into valuable lighter hydrocarbons.

A conventional way of processing of high TAN crude oils include blending of the same with low TAN crude oils to bring the acidity levels to below 0.5 mgKOH/g oil and then processing through the normal route. This involves passing the mixed crude oil to the crude desalter unit. The desalted crude oil is then sent to the atmospheric column where separation of lighter products from 'reduced crude oil' or 'long residue' takes place. The reduced crude oil is then sent to a vacuum distillation unit where the vacuum gasoils are separated from the 'vacuum residue' or 'short residue'. Naphtha components are normally processed in different units like hydrotreaters, isomerization units, reformer etc. to produce finished products like LPG, motor spirit or naphtha. Vacuum gasoils are sent to secondary processing unit(s) like hydrocracker unit (HCU) or Fluid catalytic cracking unit (FCC) for further catalytic conversion to lighter hydrocarbon products. The vacuum residue is sent to a delayed coker unit for thermal cracking to lighter products and petroleum coke.

According to one embodiment of the present invention, a method for processing of liquid hydrocarbon feedstock by thermal cracking process, wherein the said method comprises the steps of:

a) desalting neat high acidic crude oil to obtain desalted crude;
b) separating the desalted crude in a pre-fractionator column into lighter hydrocarbon material and heavier boiling material, wherein the lighter hydrocarbon material comprises of hydrocarbons boiling below 200° C.;
c) routing the heavier boiling material to the bottom section of a fractionator column and mixing with internal recycle component to obtain a secondary feed;
d) heating the secondary feed obtained in step (c) to a high temperature to obtain a hot feed;
e) thermally reacting the hot feed obtained in step (d) in reactor to obtain product vapors;
f) routing the product vapors obtained in step (e) to the fractionator column for fractionation into product fractions.

In a preferred embodiment of the present invention, the liquid feedstock is crude oil having high contents of acidic compounds with total acidic number (TAN) greater than 0.5 mg KOH/g Oil. In another embodiment of the present invention, the liquid hydrocarbon feedstock is a blend of low TAN and high TAN crude oils, wherein the TAN of the mixture of the crude oils may be greater than 0.5 mgKOH/g oil.

In another feature of the present invention, the liquid feedstock is crude oil having high contents of acidic compounds with TAN lower than 0.5 mg KOH/g Oil. In yet another embodiment of the present invention, the liquid hydrocarbon feedstock is a blend of low TAN and high TAN crude oils, wherein the TAN of the mixture of the crude oils may be lower than 0.5 mgKOH/g oil.

In general, TAN is a measure of the naphthenic acid compounds in a hydrocarbon material. Naphthenic acids are the general compound class, which cause corrosion of equipment and fouling of heat exchangers etc. In an embodiment of the present invention, high TAN crudes comprises of high metal and chloride contents and may have low as well as high sulfur contents. In another embodiment of the present invention, non-limiting examples of high TAN crudes include North Gujarat Crude, Mondo, Liuhua, Duli, Hange, Kuitu, Liaohe, Duoba, and Fula.

In another preferred feature of the present invention, the density of the crude oil may be more than 0.8 g/cc and Conradson Carbon Residue (CCR) content greater than 0.1 wt %.

In another feature of the present invention, the heavier hydrocarbon material and the lighter boiling material has boiling point greater or lower than 200° C. In a preferred embodiment of the present invention, the lighter hydrocarbon material has boiling point lower than 200° C. and the heavier boiling material has boiling point greater than 200° C.

In a preferred feature of the present invention, the product fractions obtained comprises of offgases with naphtha, light gasoil product, heavy gasoil, and fuel oil. The light gasoil product is withdrawn and passed to a treater unit. The treater unit is preferably hydrotreater unit. Further, the offgases with naphtha is passed to a gas separation section to separate gaseous products comprising of fuel gas and LPG from naphtha product and the heavy gasoil stream is sent to a secondary processing unit like hydrocracker or fluid catalytic cracker.

In another preferred feature of the present invention, the process scheme is carried out using a single pre-fractionator column, without requirement of separate crude distillation unit or vacuum distillation unit.

In yet another feature of the present invention, the process conditions are to be fine-tuned to enable separation of lighter boiling naphtha range compounds from the crude. The boiling point of the lighter boiling naphtha may be preferably lower than 200° C.

In an embodiment of the present invention, removal of the lighter hydrocarbon and heavier boiling material from the desalted crude in step (b) is carried out at pressure in the range of 1-2 $Kg/cm^2$ (g) and top temperature in the range of 150 to 250° C., preferably in the range of 190 to 210° C.

In another feature of the present invention, the secondary feed is heated in step (d) at the temperature in the range of 470° C. to 520° C., preferably in the range of 480° C. to 500° C.

In yet another feature of the present invention, the thermal reactions in step (e) are carried out at the desired operating temperature in the range of 470 to 520° C., preferably between 480° C. to 500° C. and desired operating pressure in the range of 0.5 to 5 Kg/cm' (g), preferably between 0.6 to 3 Kg/cm' (g). Further, the thermal cracking reactions in step (e) are carried out with residence time of more than 10 hours.

In another feature of the present invention, the thermal cracking reaction in step (e) is carried out in feeding mode of operation in at least two reactor drums.

The process of the present invention provides major advantages including complete destruction of naphthenic acid compounds into harmless compounds which do not cause corrosion of equipment and pipelines. This in turn benefits the refiner in terms of lesser or nil requirement of corrosion inhibitor dosing schemes. Also, in the thermal cracking process, the heavy metals, chlorides, nitrogen and similar impurities which act as poisons for catalysts of downstream units get deposited in the solid petroleum coke. The process of the present invention reduces the impurities and thereby provides relatively cleaner feedstock to the downstream units.

DESCRIPTION OF PROCESS FLOW SCHEME

In accordance with FIG. 1, a conventional way of processing high TAN crude oil includes blending of the high TAN crude (1) with low TAN crude oils (2) to make the crude oil mixture (3) having low acidity levels to avoid equipment and pipeline corrosion. The mixed crude oil stream (3) is then routed to the crude desalter unit (4), where under the application of electric field, the salts and sediments are removed from the crude oil mixture. The desalted crude oil (5) is then sent to the Atmospheric Distillation Unit or also termed as Crude Distillation Unit (CDU) (6) where the lighter materials (7) such as naphtha, kerosene, straight run diesel are separated. These lighter hydrocarbon material are then routed to treatment or processing units (14) such as hydrotreater, isomerization, reformer, hydrogen generating unit. The heavy material (8) after separation of the lighter, exiting the CDU bottom is termed as 'reduced crude oil' or 'long residue'. The reduced crude oil is then sent to a vacuum distillation unit (VDU) (9) where the vacuum gasoil (10) are separated. The vacuum gasoil stream (10) is sent to a secondary processing unit (16) for further conversion. The heavier bottom material (11) exiting the vacuum distillation unit (9) is termed as 'vacuum residue' or 'short residue'. The vacuum residue stream (10) is then routed to the delayed coker unit (12) for thermal cracking. The lighter product material (13) exiting the delayed coker units are sent to product treatment units (14) and the heavy coker gasoil stream (15) is sent to the secondary processing units (16) for further conversion. The lighter products (20) from secondary conversion units are also sent to treatment units (14) for treatment. Products (17, 18, 19) are obtained from the process scheme.

The process of present invention is exemplified in accordance to, but not limited to the FIG. 2, the neat high TAN crude oil (21) is routed to desalter unit (22) for desalting, where under the application of electric field, the salts and sediments are removed from the crude oil mixture. The desalted crude oil (23) is then routed to the pre-fractionator column (24) to remove the lighter hydrocarbon material (25) like naphtha boiling below 200° C. and the heavier boiling material boiling above 200° C. (26). Heavier boiling material (26) is then routed to the bottom section of fractionator column (27). In the fractionator column, the internal recycle component gets mixed with the heavier boiling stream (26) and is drawn out as secondary feed (39). The secondary feed (39) is then sent to a furnace (40) for heating to high temperature required for thermal cracking reactions as well as causing disintegration of acidic compounds. The hot feed (41) exiting the furnace is sent to one of the two reactor drums (43, 43), which is in feeding mode of operation. In the reactor drum, thermal cracking reactions takes place and the product vapors (44) are routed to the fractionator column (27) for fractionation into desired product cuts. The offgases with naphtha (35) is sent to the gas separation section (33), where the gasesous products (45) including fuel gas and LPG are separated from naphtha product (34). The light gasoil product (36) is withdrawn from the fractionator column (27) and sent to treater unit like hydrotreater for further treatment. The heavy gasoil stream (37) is sent to the secondary processing unit (30) which can be either a hydrocracker unit or fluid catalytic cracking unit for further conversion. The lighter hydrocarbon material (25) from the pre-fractionator column (24), naphtha (34) from gas separation section (33) and the naphtha (32) from the secondary unit (30) are sent to the naphtha/gasoline treatment section (28), to obtain the desired lighter product (29). The fuel oil (38) product withdrawn from the fractionator column (27) can be used as internal fuel oil or can also be sent for further catalytic conversion. Solid petroleum coke (29), which is formed in the reactor drums, can be used as a fuel grade coke for boilers or as anode grade coke for electrode manufacture etc. Conventional hydrocarbon products (33, 34) are produced from the process scheme. In the process scheme of the present invention, the major advantages include complete destruction of naphthenic acid compounds into harmless compounds which do not cause corrosion of equipment and pipelines downstream of the process.

The present invention has several advantageous over conventional process. The advantages of the present invention include no requirement of CDU and VDU, no metallurgy changes in downstream units, complete TAN disintegration, removal of catalyst poisons as deposits in Coke, no impact on downstream unit conversions, and no or minimum use of costly corrosion inhibitors. Further, the scheme of the present invention is ideal for capacity expansion cases & grass root refineries for processing high acidic crude oil.

In an embodiment of the present invention, the crude oil pre-fractionator operates at pressure in the range of 1-2 $Kg/cm^2$ (g).

In another feature of the present invention, top temperature of the pre-fractionator is in the range of 150 to 250° C., preferably in the range of 190 to 210° C. The process conditions are to be fine-tuned to enable separation of lighter boiling (<200° C.) naphtha range compounds from the crude.

In an embodiment of the present invention, the reactor drums in the thermal cracking section of the process may be operated at a higher severity with desired operating temperature ranging from 470 to 520° C., preferably between 480° C. to 500° C.

In another feature of the present invention, the reactor drums in the thermal cracking section operate at a desired operating pressure ranging from 0.5 to 5 $Kg/cm^2$ (g), preferably between 0.6 to 3 $Kg/cm^2$ (g). The residence time provided in rector drums is more than 10 hours.

In yet another feature of the present invention, the furnace operates at a high temperature in the range of 470° C. to 520° C., preferably in the range of 480° C. to 500° C.

EXAMPLES

The present invention is exemplified by following non-limiting examples.

Example 1

A typical high TAN crude oil from India was arranged and detailed characterization was carried out to ascertain the physic-chemical characteristics. The properties are tabulated in Table-1.

TABLE 1

Physio-chemical characteristics of crude oil

| Property | Unit | Value |
|---|---|---|
| Gravity | API | 26.0 |
| Sulfur | wt % | 0.079 |

TABLE 1-continued

Physio-chemical characteristics of crude oil

| Property | Unit | Value |
|---|---|---|
| Pour Point | ° C. | 21 |
| Viscosity @ 40° C. | Centistokes | 59.7 |
| Viscosity @ 60° C. | Centistokes | 25.2 |
| Nitrogen, Total | Weight ppm | 496 |
| Total Acid Number | mg KOH/gm | 2.09 |
| Carbon Residue | Wt % micro | 4.6 |
| Asphaltenes | Wt % | 0.38 |
| Sediment | Vol % | 0 |
| Water | Vol % | Trace |
| Chlorides as NaCl | lbs NaCl/1000 bbls | 13.1 |
| Reid Vapor Pressure | psi | 1.93 |

Crude assay analysis was carried out to find the yields of various component streams w.r.t. various cut points like naphtha, kero etc. as shown in Table-2.

TABLE 2

Crude assay data

| Yield, wt % | Crude assay |
|---|---|
| FG + LPG | 0.7 |
| LN (C5-95° C.) | 2.3 |
| HN (95-150° C.) | 3.3 |
| Kero (150-250° C.) | 9.6 |
| LGO (250-370° C.) | 20.4 |
| VGO (370-550° C.) | 33 |
| VR (550° C. +) | 30.6 |

Example 2

The high TAN crude oil sample of Example 1 was subjected to thermal cracking reaction conditions in a laboratory scale batch thermal cracker reactor unit. The experimental conditions of the unit are provided in Table-3.

TABLE 3

Operating conditions of batch thermal cracker reactor unit

| Operating condition | Unit | RUN-1 | RUN-2 |
|---|---|---|---|
| Reactor temperature | ° C. | 485 | 490 |
| Reactor pressure | $Kg/cm^2$(g) | 1 | 1 |
| Reaction time | hrs | 2 | 2 |

The high TAN crude oil sample, of which properties are given in Table-1, was subjected to thermal treatment conditions as provided in Table-4. Two runs were carried out at different reactor temperatures. The liquid products from both runs were analyzed for TAN (mgKOH/g oil) and the results are provided in Table-4.

TABLE 4

TAN analysis of liquid products from experiments

| | Crude | Liquid product of RUN-1 | Liquid product of RUN-1 |
|---|---|---|---|
| TAN, mg KOH/g | 2.10 | 0.15 | 0.10 |

It is evident from the Table-4 that the acidity of the crude oil is reduced from 2.1 mgKOH/g oil to very negligible levels of 0.1-0.15 mgKOH/g oil, which indicates that the TAN compounds are nearly completely disintegrated into harmless compounds. The liquid products after TAN reduction could be processed in the downstream units without any effect on the equipments. Also, the yield patterns from both experiments were compiled and compared in Table-5.

TABLE 5

Comparison of yield pattern from experiments with crude assay data

| Yield, wt % | Crude assay | RUN-1 | RUN-2 |
|---|---|---|---|
| FG + LPG | 0.7 | 8.1 | 7.4 |
| LN (C5-95° C.) | 2.3 | 2.7 | 2.4 |
| HN (95-150° C.) | 3.3 | 6.0 | 5.5 |
| Kero (150-250° C.) | 9.6 | 20.4 | 19.9 |
| LGO (250-370° C.) | 20.4 | 34.6 | 35.0 |
| HGO (370-540° C.) | — | 19.5 | 21.4 |
| VGO (370-550° C.) | 33 | — | — |
| VR (550° C. +) | 30.6 | — | — |
| Coke | — | 8.7 | 8.4 |

It is evident from the Table-5 above that the yields obtained from thermal cracking of high TAN crude are comparable or superior to the yield pattern from conventional way of processing the same.

Example 3

A pilot scale study using a semi-batch thermal cracking pilot plant was carried using the high TAN crude oil of Example 1 or Table-1. The process conditions employed in the pilot plant run are provided in Table-6.

TABLE 6

Operating conditions of pilot plant

| Operating condition | Unit | Value |
|---|---|---|
| Reactor temperature | ° C. | 490 |
| Reactor pressure | $Kg/cm^2(g)$ | 1 |
| Feed rate | Kg/hr | 8 |
| Cycle time | hrs | 12 |

The combined liquid product was collected and analyzed for TAN and the result is compared with feed in Table-7.

TABLE 7

TAN analysis of liquid products from experiments

| | Crude | Liquid product of Pilot plant run |
|---|---|---|
| TAN, mg KOH/g | 2.10 | 0.42 |

Table-7 above confirms the reduction of TAN content by thermal treatment process of present invention in pilot scale study, as well.

Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

The invention claimed is:

1. A method for processing a high acidic crude oil by thermal cracking process, the method comprising:

a) desalting the high acidic crude oil to obtain a desalted crude;

b) separating the desalted crude in a pre-fractionator column into a lighter hydrocarbon material and a heavier boiling material, wherein the lighter hydrocarbon material does not contain acidic compounds;

c) routing the heavier boiling material from the pre-fractionator to a bottom section of a fractionator column and mixing with an internal recycle component in the fractionator column and drawing out from the fractionator column as a secondary feed;

d) heating the secondary feed obtained in step (c) to a high temperature in a furnace to disintegrate acidic compounds of the high acidic crude oil and to obtain a hot feed;

e) thermally reacting the hot feed obtained in step (d) in reactors to obtain product vapors; and f) routing the product vapors obtained in step (e) to the fractionator column for fractionation into product fractions.

2. The method as claimed in claim 1, wherein the desalting step (a) is carried out under application of an electric field.

3. The method as claimed in claim 1, wherein the high acidic crude oil has high contents of acidic compounds with a total acidic number (TAN) greater than 0.5 mg KOH/g Oil.

4. The method as claimed in claim 1, wherein the high acidic crude oil is a blend of low TAN and high TAN crude oils, wherein the TAN of the blend is greater than 0.5 mgKOH/g oil.

5. The method as claimed in claim 1, wherein the lighter hydrocarbon material has a boiling point lower than 200° C.

6. The method as claimed in claim 1, wherein the heavier boiling material has a boiling point greater than 200° C.

7. The method as claimed in claim 1, wherein removal of the lighter hydrocarbon and heavier boiling material from the desalted crude in step (b) is carried out at a pressure in the range of 1-2 $Kg/cm^2$ (g) and at a top temperature in the range of 150 to 250° C.

8. The method as claimed in claim 1, wherein the secondary feed is heated in step (d) at a temperature in the range of 470 to 520° C.

9. The method as claimed in claim 1, wherein thermally reacting the hot feed in step (e) comprises reacting at a temperature in the range of 470 to 520° C. and at a pressure in the range of 0.5 to 5 $Kg/cm^2$ (g).

10. The method as claimed in claim 1, wherein thermally reacting the hot feed in step (e) comprises thermally reacting for a residence time of more than 10 hours.

11. The method as claimed in claim 1, wherein thermally reacting the hot feed comprises thermally reacting in the reactors that operate in feeding mode of operation.

12. The method as claimed in claim 1, wherein the product fractions obtained in step (f) comprises offgases with naphtha, light gasoil product, heavy gasoil, and fuel oil.

13. The method as claimed in claim 12, wherein the offgases with naphtha are passed to a gas separation section to separate gaseous products comprising a fuel gas and LPG.

14. The method as claimed in claim 12, wherein the heavy gasoil is sent to a secondary processing unit to obtain products including naphtha, wherein the secondary processing unit is at least one of a hydrocracker unit and a fluid catalytic cracking unit.

15. The method as claimed in claim 14, wherein the lighter hydrocarbon material, the naphtha from the gas separation section and the naphtha from the secondary processing unit are treated to obtain a desired lighter product.

16. The method as claimed in claim 1, wherein the thermal cracking process produces a solid petroleum coke as a byproduct.

* * * * *